US007934349B1

(12) United States Patent
Romig

(10) Patent No.: US 7,934,349 B1
(45) Date of Patent: May 3, 2011

(54) FIRE RESISTANT WALL

(76) Inventor: Frederick W. Romig, Wexford, PA (US)

( * ) Notice: Subject to any disclaimer, the term of this patent is extended or adjusted under 35 U.S.C. 154(b) by 93 days.

(21) Appl. No.: 12/273,613

(22) Filed: Nov. 19, 2008

(51) Int. Cl.
*E04B 1/00* (2006.01)
*E04B 2/00* (2006.01)

(52) U.S. Cl. ..... 52/653.1; 52/796.1; 52/309.1; 52/309.4; 52/407.1; 52/407.2; 52/407.3; 52/782.1; 52/653.2; 52/481.1; 52/783.11

(58) Field of Classification Search ..... 52/782.1, 52/309.1, 309.4, 309.8, 415, 439, 434, 408, 52/404.1, 406.1, 407.1, 407.3, 407.4, 506.06, 52/504, 784.15, 794.1, 481.1, 653.2, 653.1, 52/671, 674, 406.2, 406.3, 783.1, 783.13, 52/783.17, 784.11, 787.11, 796.1, 798.1
See application file for complete search history.

(56) References Cited

U.S. PATENT DOCUMENTS

| | | | | | |
|---|---|---|---|---|---|
| 1,581,487 | A * | 4/1926 | Kohler | 52/653.2 |
| 2,067,403 | A * | 1/1937 | Lea | 52/481.1 |
| 3,124,847 | A * | 3/1964 | Charniga, Jr. | 52/198 |
| 3,239,982 | A * | 3/1966 | Nicosia | 52/309.7 |
| 3,654,067 | A * | 4/1972 | Klein | 428/448 |
| 4,165,591 | A * | 8/1979 | Fitzgibbon | 52/91.1 |
| 4,282,687 | A * | 8/1981 | Teleskivi | 49/503 |
| 5,950,385 | A * | 9/1999 | Herren | 52/481.1 |
| 6,901,713 | B2 * | 6/2005 | Axsom | 52/481.1 |
| 2002/0020141 | A1 * | 2/2002 | Payer | 52/741.11 |
| 2004/0103610 | A1 * | 6/2004 | Axsom | 52/481.1 |
| 2006/0026925 | A1 * | 2/2006 | Layfield | 52/782.1 |
| 2006/0070321 | A1 * | 4/2006 | Au | 52/232 |

OTHER PUBLICATIONS

NRC-IRC, Fire Resistance and Sound Insualtion of Load-Bearing Stud Wall Assemblies, Mar. 2, 2007, 7 pages.
United States Gypsum Company, Sheetrock brand Ultracode Core Gypsum Panels, Submittal Sheet 09250, 2 pages.
THERMAFIBER, Sound Attenuation Fire Blankets (SAFB), 2003, pp. 1-12.

* cited by examiner

*Primary Examiner* — Jeanette E. Chapman
(74) *Attorney, Agent, or Firm* — Eckert Seamans Cherin & Mellott, LLC; David C. Jenkins, Esquire

(57) ABSTRACT

A fire resistant wall includes a frame assembly utilizing tubular steel studs having at least one opening at the bottom and at the top, a stratum of fire resistant material disposed in the inter-stud space, and a trim assembly structured to protect the gaps between adjacent panels. The openings in the studs allow hot fluid within the studs to be exhausted in a remote location and cool fluid to be drawn in from another remote location. The stratum of fire resistant material disposed in the inter-stud space resists heat and flames contacting the lateral sides of the studs when the inner stratum of the firewall collapses, or when gaps appear between adjacent inner stratum panels. The trim assembly preferably includes a metal bar with a concave back surface disposed over the gap between adjacent panels and an intumescent caulk disposed at least partially within the gap. An intumescent caulk expands when exposed to heat and fills the gap between inner stratum panels.

12 Claims, 5 Drawing Sheets

FIRE RESISTANT WALL

FIELD OF INVENTION

This invention relates to fire resistant walls and, more specifically to a fire resistant wall having a thinner profile than prior art fire resistant walls.

BACKGROUND OF THE INVENTION

Fire resistant walls typically include a frame assembly formed from a plurality of steel channel studs and cross members as well as a stratum of gypsum disposed on both the inner side and the outer side of the frame assembly. The fire resistant wall typically has a stratum of insulation disposed between the studs. The use of gypsum, which is fire resistant, on both the inner side and the outer side of the frame assembly is a relatively inexpensive construct that is capable of passing standard fire resistance tests. That is, in this configuration, the spread of fire from one side of the wall to the other is resisted for a set period of time. During the test, fire is applied to an "inner" side of the wall, and temperature measurements are taken at a number of points on the "outer" side of the wall. During the test, the inner stratum of gypsum is consumed by the fire over a period of time. Typically, a gypsum stratum, or a portion thereof, remains in tact until water and the gypsum, vermiculite and/or similar material fibers within the stratum are destroyed at which time the gypsum stratum, or a portion thereof, crumbles into dust. The destruction of the inner stratum of gypsum has two detrimental effects. First, and most obvious, with the inner stratum gone, the fire may spread to the insulation and outer stratum of gypsum. Second, when the inner stratum is destroyed, structural support for the frame assembly is removed. To pass the test, a fire resistant wall must both delay the spread of the fire for a set period of time (as measured by sensors on the outer side of the wall and which must detect a temperature above a predetermined limit) and ensure that the elements of the frame assembly can survive a fire hose test. That is, after the test, elements of the frame assembly must be able to withstand the force created by a fire hose.

The use of both an inner and outer stratum of gypsum held ensures that the frame assembly will not collapse when the stratum layer of gypsum is consumed by the fire. That is, the outer stratum of gypsum adds rigidity to the frame assembly even when the inner stratum of gypsum is destroyed. Further, as noted above, gypsum is fire resistant and helps delay the spread of the fire. This construct, however, tends to be thick. Thus, each wall occupies a set amount of floor space that could be used for other purposes.

Further, the use of steel channel studs, while sufficient for supporting a fire resistant wall, does not have sufficient strength to create a blast resistant wall. Blast resistant walls are required in certain types of construction such as, but not limited to, hazardous material storage. Tubular steel studs increase the strength of the frame assembly, but are known to trap heat within the members. Given that the most elements of the fire resistant wall are coupled directly to the frame assembly, this allows heat to be transferred via conduction from one side of the wall to the other. This is not a desirable effect.

The insulation used in the intra-stud spaces has not necessarily been a fire resistant material. For example, fiberglass insulation melts at about 1000 degrees Fahrenheit. Typically, the insulation is selected for the insulative qualities of the material. Thus, during a fire, before the inner stratum of gypsum is breached, the insulation burns. Thus, when the inner stratum of gypsum is heated, the heat is passed into an, essentially, empty space. This heat is then transferred to the inner side of the outer surface and may cause the outer layer of gypsum to overheat.

Further, it is noted that the gypsum strata is typically composed of a plurality of panels. During a fire these panels tend to shrink and gap. That is, as water and other materials within the panel are consumed, a gap may appear between adjacent panels. Such a gap allows the fire to pass into the fire resistant wall and consume the insulation and/or heat the frame assembly. Again, this is not a desirable effect.

SUMMARY OF THE INVENTION

The concept disclosed below, and as recited in the claims, provides for an improved fire resistant wall that addresses these issues. The fire resistant wall includes a frame assembly utilizing metal plates welded to the outer surface of tubular steel studs having at least one opening at the bottom and at the top. In this configuration, fluid, which is typically air, within the stud will circulate when heated. That is, hot fluid will naturally rise and exit the stud via the upper opening. Further, cooler fluid will enter the lower opening and move into the stud thereby slowing the rate of heating within the stud. Preferably, the studs are coupled to a horizontal top member and bottom member. The top and bottom members are also hollow and have openings in fluid communication with the stud openings. In this configuration, the hot fluid may be exhausted and cool fluid may be drawn in. Because heat exits the wall via exhausting hot fluid through the tubular members, the heat is not passed to the outer wall.

The fire resistant wall further includes a stratum of fire resistant material disposed in the inter-stud space. That is, unlike the prior art which only had an insulation between the studs, the firewall has a gypsum stratum, or other fire resistant material, extending between the studs. In this configuration, when the inner stratum collapses, or when gaps appear between adjacent inner stratum panels, heat and flames do not contact the lateral sides of the studs and the collapsed stratum is pressed against the inside surface of the outer metal plate. Rockwool insulation bats are preferred to hold the gypsum against the plate. Thus, heat transfer is reduced and little heat is passed to the outer surface of the metal plate.

The fire resistant wall further includes a trim assembly structured to protect the gaps between adjacent panels. The trim assembly preferably includes a metal bar member, having a concave back surface, disposed over the gap between adjacent panels and an intumescent caulk disposed at least partially within the gap and under the bar. An intumescent caulk is a caulk that expands when exposed to heat. Thus, the trim assembly bar initially resists heated air and flames attempting to pass through the gap and, after the panels shrink, the intumescent caulk expands to fill the gap and continues to substantially seal the gap.

DESCRIPTION OF THE PREFERRED EMBODIMENT

As used herein, a "stratum" is a layer of specific type of material. The stratum may be comprised of one or more panels of that material.

As used herein, a "strata" shall mean a construct having two or more stratums. The different stratums may be mechanically coupled together, e.g., by fasteners, adhesives, or other devices, may be formed together, e.g. two stratums of foam poured against each other or a stratum of foam poured on a rigid panel, or may simply be placed adjacent to, or in contact with, each other.

As used herein, "steel" is understood to include steel alloys.

As used herein, a "fire resistant board" shall mean a board made from gypsum, vermiculite, or similar materials and any combination thereof.

It is understood that the phrase "internal side" means the side of the firewall wherein a fire occurs, or is likely to occur. Conversely, the "external side" is the side of the firewall opposite where a fire occurs, or is likely to occur.

Figure 1:
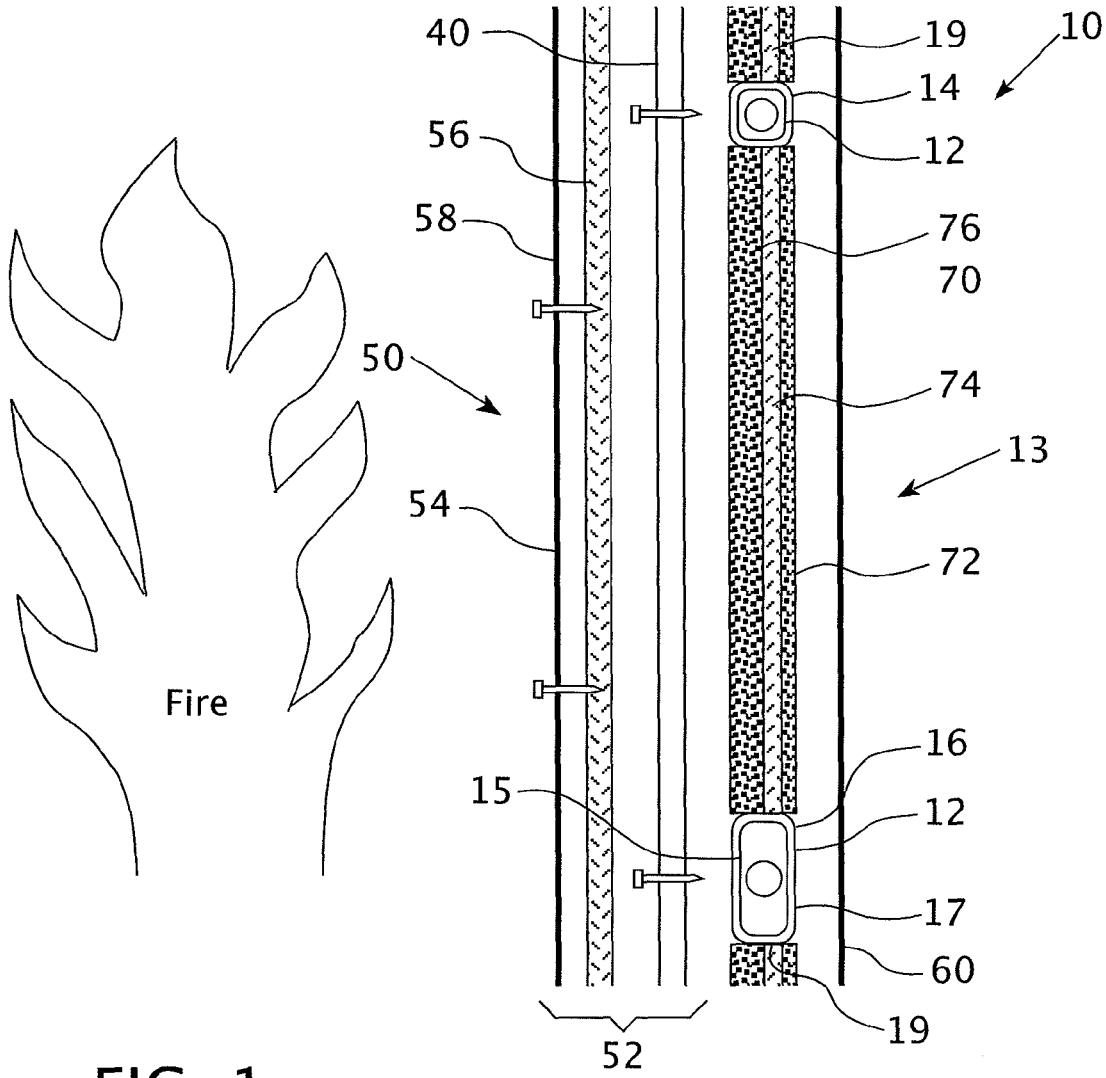
FIG. 1 is a top cross-sectional exploded view of a firewall.
Figure 2:
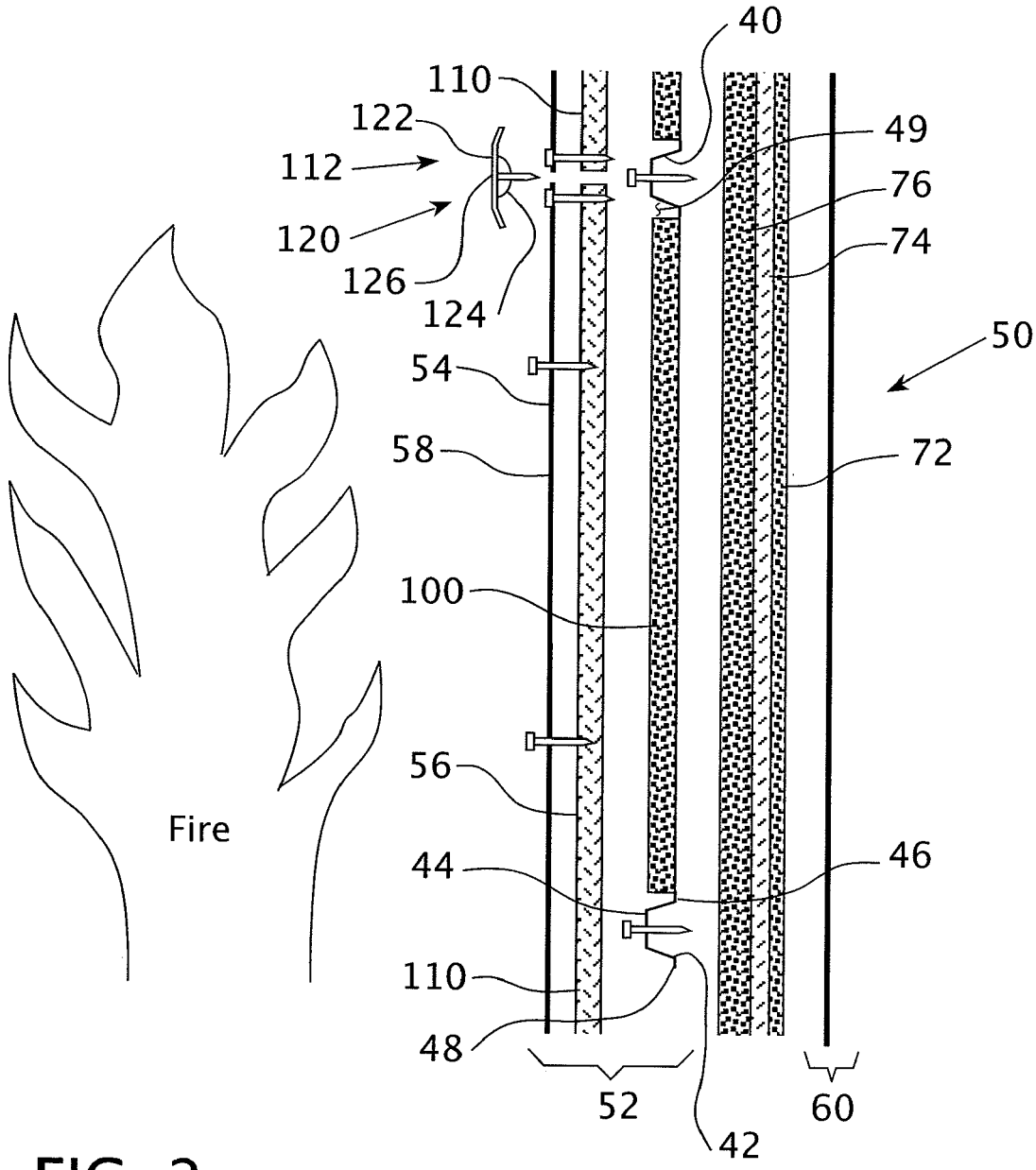
FIG. 2 is a side cross-sectional exploded view of a firewall.
Figure 3:
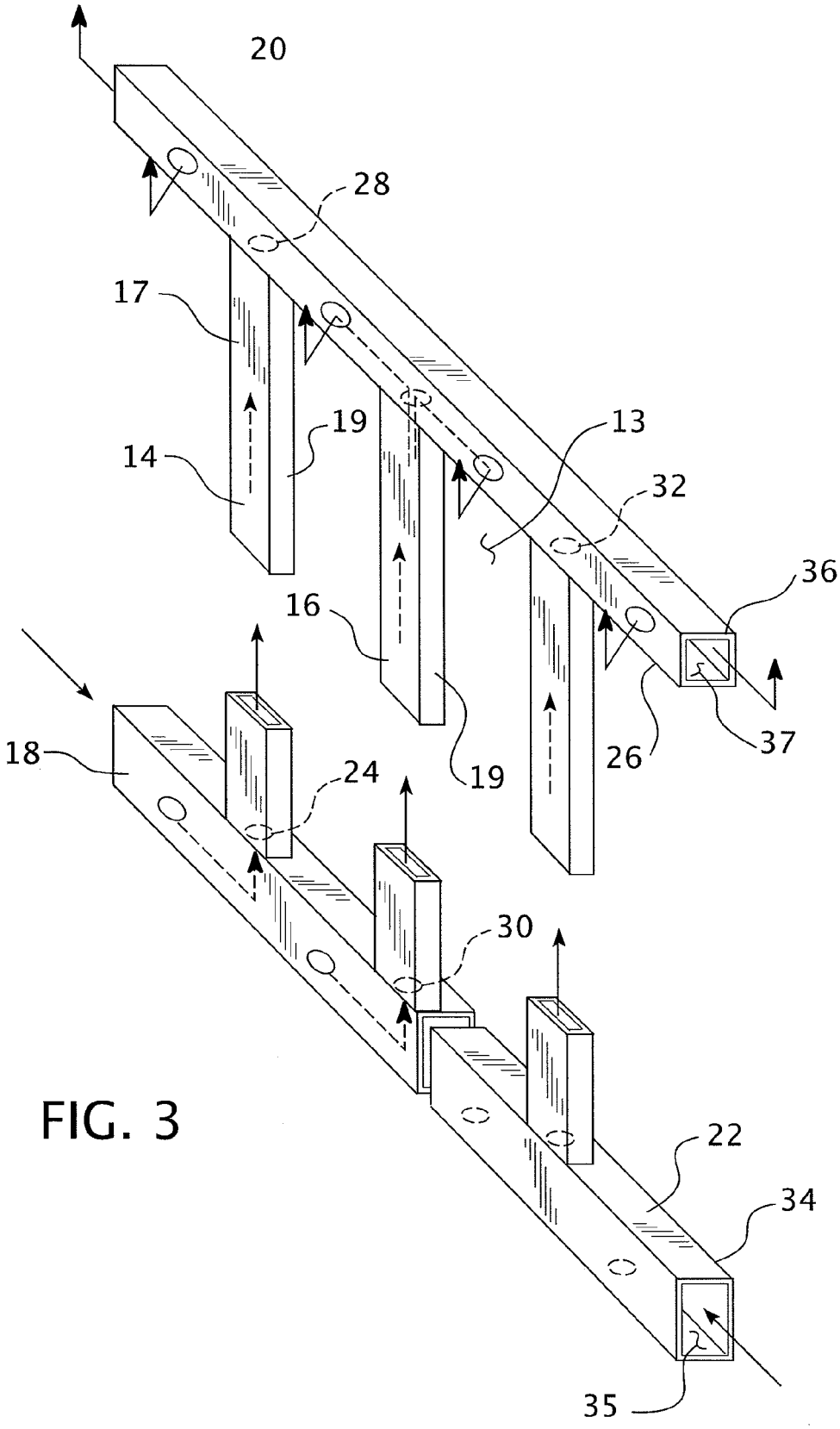
FIG. 3 is a schematic broken line view of the frame assembly.

As shown in FIGS. 1 and 2, a firewall 10 includes a frame assembly 12 and a wall assembly 50. The frame assembly 12 includes at least two hollow, tubular steel studs 14, 16 extending generally vertically and, preferably, includes a generally horizontal, generally hollow base member 18 and a generally horizontal, generally hollow top member 20. The studs 14, 16 each have an inner surface 15 and an outer surface 17, as well as two lateral surfaces 19. Between each pair of studs 14, 16 is an inter-stud space 13. The base member 18 has an upper surface 22 having at least one opening 24 therein. The top member 20 has a lower surface 26 having at least one opening 28 therein. The studs 14, 16 each have at least one lower opening 30 and at least one upper opening 32. The at least one lower opening 30 and at least one upper opening 32 may be located on a longitudinal side, i.e. one of the inner surface 15, and outer surface 17, or one of the two lateral surfaces 19 (not shown), but in the preferred embodiment, the studs 14, 16 are coupled to, and extend between, the base member 18 and the top member 20. Thus, in the preferred embodiment, each stud's 14, 16 at least one lower opening 30 and at least one upper opening 32 are on the axial ends of the studs 14, 16. Further, each base member upper surface at least one opening 24 is aligned, and in fluid communication with, each stud at least one lower opening 30. Similarly, each top member lower surface at least one opening 28 is aligned, and in fluid communication with, each stud at least one upper opening 32. In this configuration, a fluid, such as air, may circulate from the base member 18, through the studs 14, 16, and the top member 20.

Further, the base member 18 and the top member 20 preferably extend to locations remote from the studs 14, 16. The lateral ends 34, 36 of the base member 18 and the top member 20 have openings 35, 37, respectively, which allow fluid flow communication with the atmosphere. It is noted that the lateral ends 34, 36 may be coupled to additional passages between the frame assembly 12 and the atmosphere and/or may include protective devices such as, but not limited to, vent covers, screens, and such (not shown). In this configuration, when the studs 14, 16 are exposed to heat, the hot fluid will naturally rise and exit the studs 14, 16 via each stud at least one upper opening 32. The hot fluid will pass into the top member 20 and be exhausted via a lateral end 36. As the hot fluid is exhausted, cooler fluid is drawn into the studs 14, 16 via the base member lateral end 34 and passes through the base member 18 and through the base member upper surface at least one opening 24 and into a stud 14, 16. Thus, a cooling air circuit is created when the studs 14, 16 are exposed to heat, such as but not limited to, heat from a fire.

The frame assembly 12 may also include at least two horizontal furrings 40, 42. The furrings 40, 42 are, preferably, made from steel. A furring 40, 42 is, typically, an elongated U-shaped channel having a base 44 with two tines having distal tips 46, 48. The distal tips 46, 48 are coupled, preferably by welding, to the inner surface 15 of each stud. Between the furrings 40, 42, as well as between the furrings 40, 42 and either the ceiling or the floor, is an intra-furring space 49.

The wall assembly 50 includes various strata and stratums as described below. An inner strata 52 includes a sheet steel stratum 54 and a fire resistant board stratum 56. The sheet steel stratum 54 preferably includes a porcelain stratum 58 disposed on the outer side of the sheet steel stratum 54. Thus, the porcelain stratum 58 is the exposed surface on the internal side of the firewall 10. The wall assembly 50 further includes an outer stratum 60, which is preferably steel plate. The outer stratum 60 is the external side of the firewall 10. The inner strata 52 and the outer stratum 60 are both offset relative to the frame assembly 12. That is, the inner strata 52 and the outer stratum 60 are not disposed within the plane of the frame assembly 12. The inner strata 52 is coupled to the stud inner surface 15. Preferably, the inner strata 52 is directly coupled to the furrings 40, 42. The outer stratum 60 is coupled, and preferably directly coupled, to the stud outer surface 17.

Figure 4:
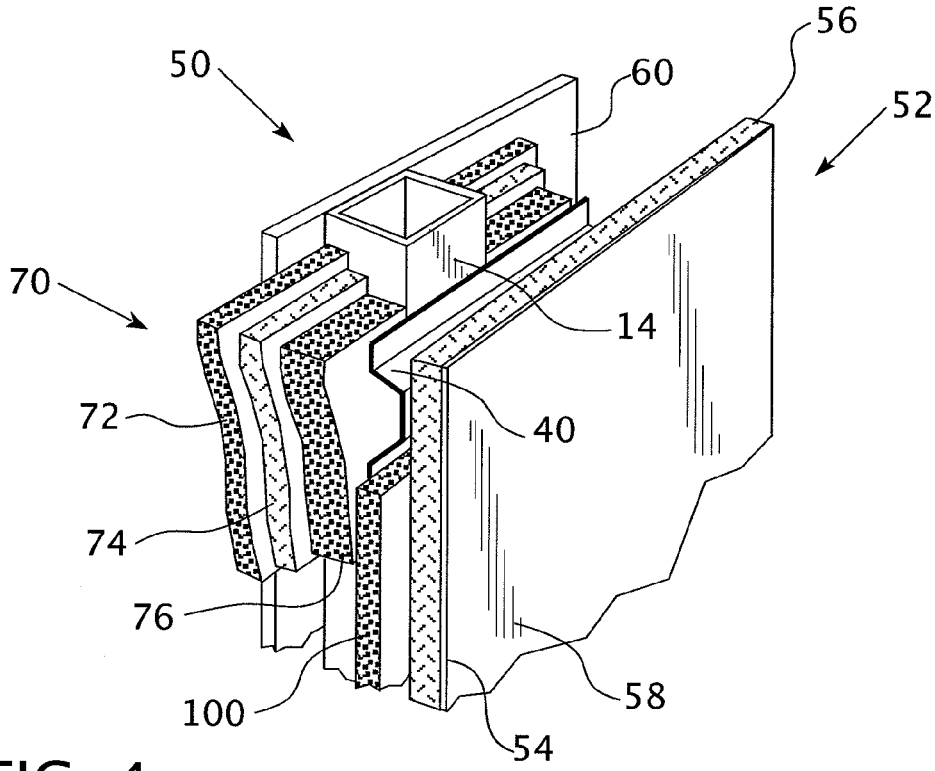
FIG. 4 is an isometric broken line view of the firewall according to a first embodiment.
Figure 5:
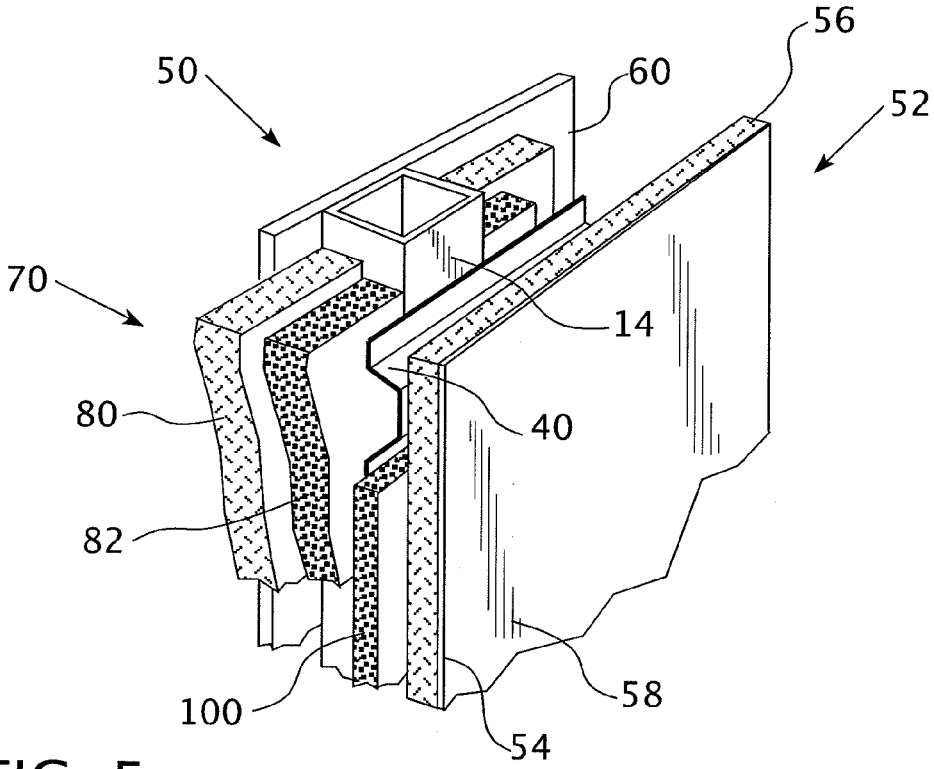
FIG. 5 is an isometric broken line view of the firewall according to a second embodiment.
Figure 6:
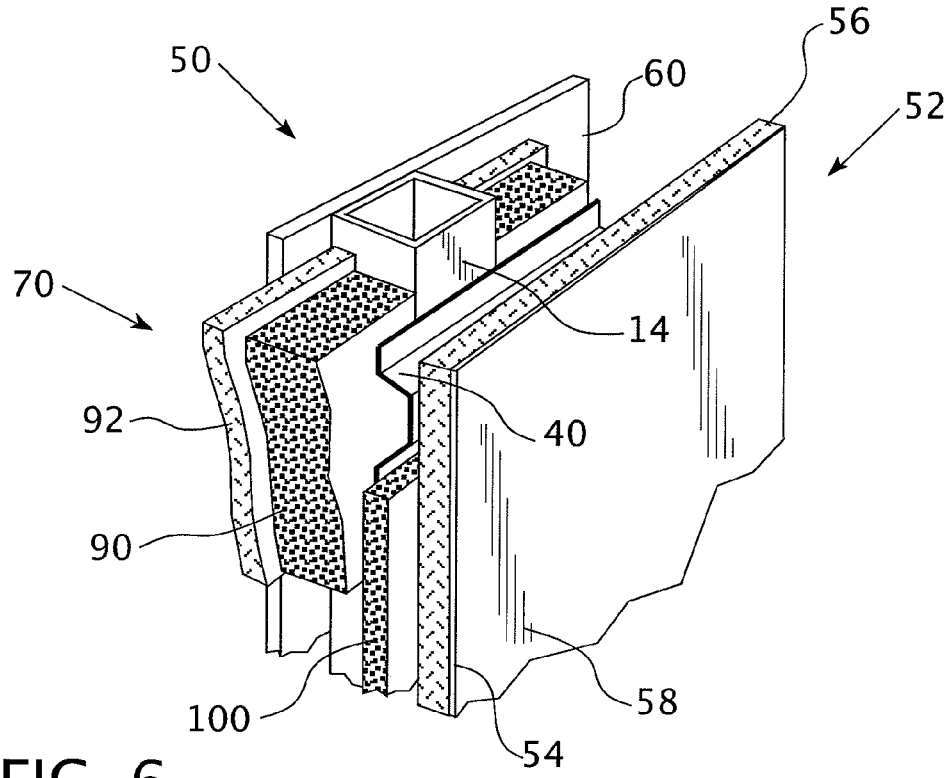
FIG. 6 is an isometric broken line view of the firewall according to a third embodiment.
Figure 7:
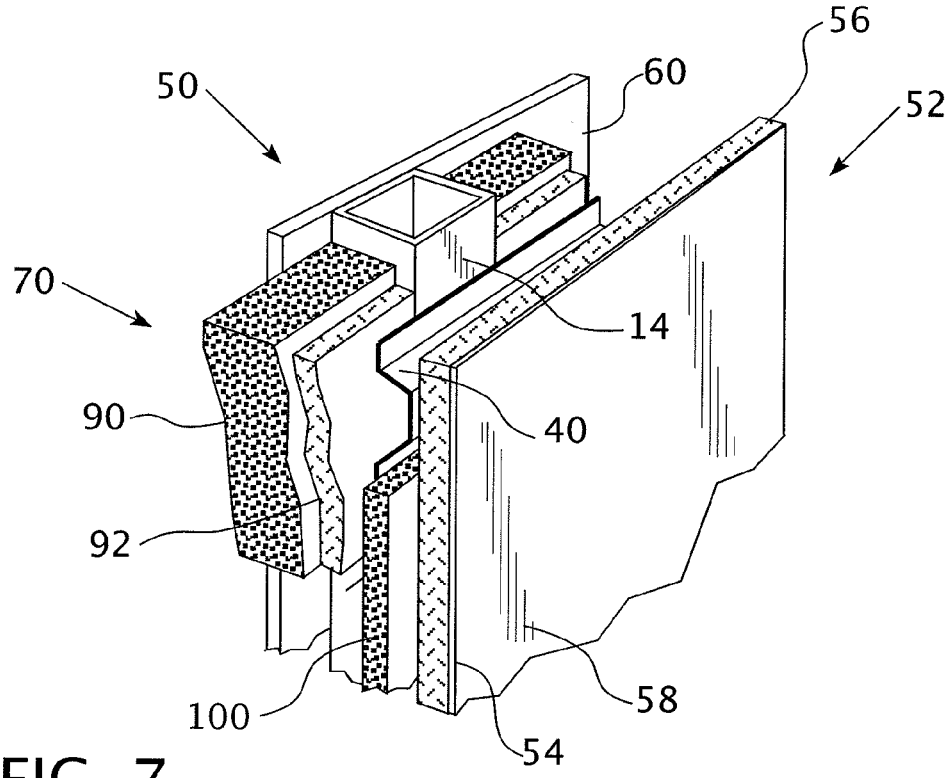
FIG. 7 is an isometric broken line view of the firewall according to a fourth embodiment.

The wall assembly 50 further includes an inter-stud strata 70 within the inter-stud space 13. The inter-stud strata 70 extends between adjacent studs 14, 16 and contacts the lateral surfaces 19 of the adjacent studs 14, 16. In this configuration, the studs 14, 16 lateral surfaces 19 are generally not exposed to heat and flames when the inner strata 52 is destroyed by fire. As shown in FIG. 4, the inter-stud strata 70 preferably includes a thermax board stratum 72, a fire resistant board stratum 74 and a thermafiber stratum 76. The inter-stud strata fire resistant board stratum 74 is disposed between the thermax board stratum 72 and the thermafiber stratum 76. The inter-stud strata thermafiber stratum 76 is disposed on the internal side, i.e. fire side, of the inter-stud strata 70. In a second alternate embodiment, shown in FIG. 5, the inter-stud strata 70 includes a thermax board stratum 80 and a thermafiber stratum 82, with the thermafiber stratum 82 disposed on the internal side, i.e. fire side, of the inter-stud strata 70. In alternate embodiments, shown in FIGS. 6 and 7, the inter-stud strata 70 includes a thermafiber stratum 90 and a fire resistant board stratum 92. As shown in FIG. 6, in the third embodiment, the thermafiber stratum 90 is disposed on the internal side, i.e. fire side, of the inter-stud strata 70. As shown in FIG. 7, in the fourth embodiment, the fire resistant board stratum 92 is disposed on the internal side, i.e. fire side, of the inter-stud strata 70.

Further protection of the frame assembly 12 may be accomplished by providing an additional stratum to the inner strata 52 structured to extend into the intra-furring space 49. That is, the inner strata 52 may further include a thermafiber stratum 100 disposed between the at least two horizontal furrings 40, 42.

The inner strata 52 is typically constructed of a series of elongated panels 110. The inner strata panels 110 preferably have generally straight edges. Preferably, the inner strata panels 110 extend the width of the firewall 10 and, as such, there are preferably only horizontal gaps 112, or seams, between the inner strata panels 110. It is noted that for a smooth appearance, the inner strata panels 110 are typically disposed immediately adjacent to each other forming seams; however, as noted above, when heat is applied to the inner strata panels 110, the panels shrink. Thus, even where a gap 112 did not exist originally, a gap 112 is typically created upon the occurrence of a fire. Accordingly, as used herein, a gap 112 also means a seam between inner strata panels 110.

As shown in FIG. 2, a trim assembly 120 is disposed over each gap 112 between adjacent inner strata panels 110. The trim assembly 120 includes an outer cover 122 and intumescent caulk 124. The outer cover 122 is structured to form a space between the central portion of the outer cover 122 and the inner strata panels 110. That is, the outer cover 122 is arcuate, or a similar shape. The intumescent caulk 124 is disposed between the outer cover 122 and the inner strata panels 110 and at least partially fills the gap 112. The intumescent caulk 124 may couple the outer cover 122 to the inner strata panels 110, however, it is preferred that a fastener, such as, but not limited to, a nail 126 couples the outer cover 122 to the inner strata panels 110 or to one of the furrings 40, 42.

In the event of a fire, the intumescent caulk 124 is structured to expand. As the intumescent caulk 124 expands, the intumescent caulk 124 fills the space between the central portion of the outer cover 122 and the inner strata panels 110 and will fill any portion of the gap 112 that is not filled with caulk 124. That is, even if the inner strata panels 110 shrink, the intumescent caulk 124 expands to fill the space therebetween. As such, fire and/or heated gas is less likely to penetrate the inner strata 52 via the gap 112.

In view of these features, the firewall 10 disclosed herein has a reduced thickness relative to traditional firewalls having two offset stratums of fire resistant board while maintaining a similar, or having an improved, resistance to the spread of fire and collapse.

While particular embodiments of the invention have been disclosed above for purposes of illustration, it will be evident to those skilled in the art that numerous variations of the details may be made without departing from the invention as defined in the appended claims.

What is claimed is:

1. A firewall comprising:

a frame assembly having at least two tubular steel studs extending generally vertically, each said stud having an inner surface, and outer surface, said studs defining an inter-stud space therebetween;

a wall assembly having an offset inner strata, an inter-stud strata, and an offset outer stratum;

said wall assembly inner strata coupled to said each said stud inner side;

said wall assembly outer stratum directly coupled to each said stud outer side;

said inter-stud strata disposed in said inter-stud space;

said frame assembly includes at least two spaced, horizontal furrings extending between and coupled to said each said stud inner surface;

said offset inner strata includes a thermafiber stratum disposed between said at least two horizontal furrings; and said inner strata being directly coupled to said at least two horizontal furrings.

2. The firewall of claim 1 wherein:

said inner strata includes a sheet steel stratum and a fire resistant board stratum; and wherein said fire resistant board stratum is internal to said sheet steel stratum; and said outer stratum is a steel plate stratum.

3. The firewall of claim 1 wherein said inner strata further includes a porcelain stratum disposed on the outer side of said sheet steel stratum.

4. A firewall comprising:

a frame assembly having at least two tubular steel studs extending generally vertically, each said stud having an inner surface, and outer surface, said studs defining an inter-stud space therebetween;

a wall assembly having an offset inner strata, an inter-stud strata, and an offset outer stratum;

said wall assembly inner strata coupled to said each said stud inner side;

said wall assembly outer stratum directly coupled to each said stud outer side;

said inter-stud strata disposed in said inter-stud space;

said studs are hollow and include at least one lower opening and at least one upper opening; and wherein, when said studs are exposed to heat, heated fluid within each said stud rises to the top of each said stud and exits each said stud via said at least one upper opening while fluid is drawn into each said stud via said at least one lower opening.

5. The firewall of claim 4 wherein:

said frame assembly includes a generally horizontal, generally hollow base member and a generally horizontal, generally hollow top member;

said base member having an upper surface with a plurality of openings and at least one lateral end opening;

said top member having an lower surface with a plurality of openings and at least one lateral end opening;

each said stud disposed between said base member and said top member with each stud at least one lower opening in fluid communication with at least one said base member upper surface opening and each stud at least one upper opening in fluid communication with at least one said top member lower surface opening; and wherein, when said studs are exposed to heat, heated fluid within each said stud rises to the top of each said stud and exits each said stud via said at least one upper opening into said top member, said top member exhausting heated fluid via said lateral end opening, while fluid is drawn into each said stud via said bottom member lateral end opening and further passing through said base member and entering each said via said at least one lower opening.

6. A firewall comprising:

a frame assembly having at least two tubular steel studs extending generally vertically, each said stud having an inner surface, and outer surface, said studs defining an inter-stud space therebetween;

a wall assembly having an offset inner strata, an inter-stud strata, and an offset outer stratum;

said wall assembly inner strata coupled to each said stud inner side;

said wall assembly outer stratum directly coupled to each said stud outer side;

said inter-stud strata disposed in said inter-stud space;

said inner strata includes a plurality of panels each having generally straight edges;

said inner strata panels coupled to said frame assembly with said inner strata panel straight edges disposed adjacent to each other, but with a gap therebetween;

a trim assembly disposed at each gap between adjacent inner strata panels;

said trim assembly including an outer cover and intumescent caulk;

said intumescent caulk being partially disposed in each said gap;

said trim assembly cover coupled to said intumescent caulk and disposed over said gap; and wherein, when said inner strata is exposed to heat, said intumescent caulk expands and fills any portion of said gap that is not filled with caulk.

7. A firewall comprising:

a frame assembly having at least two tubular steel studs extending generally vertically, each said stud having an inner surface, and outer surface, said studs defining an inter-stud space therebetween;

a wall assembly having an offset inner strata and an offset outer stratum;

said wall assembly inner strata coupled to each said stud inner surface;

said wall assembly outer stratum directly coupled to each said stud outer surface;

said studs being hollow and include at least one lower opening and at least one upper opening;

wherein, when said studs are exposed to heat, heated fluid within each said stud rises to the top of each said stud and exits each said stud via said at least one upper opening while fluid is drawn into each said stud via said at least one lower opening;

said inner strata includes a plurality of panels each having generally straight edges;

said inner strata panels coupled to said frame assembly with said inner strata panel straight edges disposed adjacent to each other, but with a gap therebetween;

a trim assembly disposed at each gap between adjacent inner strata panels;

said trim assembly including and outer cover and intumescent caulk;

said intumescent caulk being partially disposed in each said gap;

said trim assembly cover coupled to said intumescent caulk and disposed over said gap; and wherein, when said inner strata is exposed to heat, said intumescent caulk expands and fills any portion of said gap that is not filled with caulk.

8. The firewall of claim 7 wherein said wall assembly further includes an inter-stud strata disposed in said inter-stud space.

9. The firewall of claim 7 wherein said inter-stud strata includes a fire resistant board stratum.

10. The firewall of claim 7 wherein:

said inner strata includes a sheet steel stratum and a fire resistant board stratum;

wherein said fire resistant board stratum is internal to said sheet steel stratum; and said outer stratum is a steel plate stratum.

11. The firewall of claim 10 wherein said inner strata further includes a porcelain stratum disposed on the outer side of said sheet steel stratum.

12. A firewall comprising:

a frame assembly having at least two tubular steel studs extending generally vertically, each said stud having an inner surface, and outer surface, said studs defining an inter-stud space therebetween;

a wall assembly having an offset inner strata and an offset outer stratum;

said wall assembly inner strata coupled to said each said stud inner surface;

said wall assembly outer stratum directly coupled to each said stud outer surface;

said inner strata includes a plurality of panels each having generally straight edges;

said inner strata panels coupled to said frame assembly with said inner strata panel straight edges disposed adjacent to each other, but with a gap therebetween;

a trim assembly disposed at each gap between adjacent inner strata panels;

said trim assembly including and outer cover and intumescent caulk;

said intumescent caulk being partially disposed in each said gap;

said trim assembly cover coupled to said intumescent caulk and disposed over said gap; and wherein, when said inner strata is exposed to heat, said intumescent caulk expands and fills any portion of said gap that is not filled with caulk.

* * * * *

UNITED STATES PATENT AND TRADEMARK OFFICE

CERTIFICATE OF CORRECTION

PATENT NO. : 7,934,349 B1
APPLICATION NO. : 12/273613
DATED : May 3, 2011
INVENTOR(S) : Frederick W. Romig It is certified that error appears in the above-identified patent and that said Letters Patent is hereby corrected as shown below:

Title page, item (56), column 2, line 5, “Insualtion” should read --Insulation--.
Column 1, line 26, “in tact” should read --intact--.
Column 1, line 42, “gypsum held” should read --gypsum--.
Column 1, line 67, “into an,” should read --into an--.
Column 5, line 64, “stratum; and” should read --stratum;--.
Column 6, line 29, “having an lower” should read --having a lower--.
Column 6, line 45, “each said via” should read --each said stud via--.
Column 7, line 34, “including and outer” should read --including an other--.
Column 8, line 32, “including and outer” should read --including an outer--.

Signed and Sealed this
Thirteenth Day of December, 2011

David J. Kappos

David J. Kappos
*Director of the United States Patent and Trademark Office*